US008887677B2

(12) United States Patent
Boese

(10) Patent No.: US 8,887,677 B2
(45) Date of Patent: Nov. 18, 2014

(54) SINTERED STATOR-COVER UNIT AND CAMSHAFT ADJUSTER

(75) Inventor: Olaf Boese, Nurnberg (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 94 days.

(21) Appl. No.: 13/576,055

(22) PCT Filed: Jan. 17, 2011

(86) PCT No.: PCT/EP2011/050525
§ 371 (c)(1),
(2), (4) Date: Jul. 30, 2012

(87) PCT Pub. No.: WO2011/098321
PCT Pub. Date: Aug. 18, 2011

(65) Prior Publication Data

US 2012/0298061 A1 Nov. 29, 2012

(30) Foreign Application Priority Data

Feb. 15, 2010 (DE) ..... 10 2010 008 005

(51) Int. Cl.
*F01L 1/34* (2006.01)
*F01L 1/344* (2006.01)

(52) U.S. Cl.
CPC ..... *F01L 1/3442* (2013.01); *F01L 2001/34469* (2013.01); *F01L 2820/01* (2013.01); *F01L 2101/00* (2013.01); *F01L 2103/00* (2013.01)
USPC ..... 123/90.17

(58) Field of Classification Search
USPC ..... 123/90.15, 90.17
See application file for complete search history.

(56) References Cited

U.S. PATENT DOCUMENTS

| | | | | |
|---|---|---|---|---|
| 6,311,654 | B1 | 11/2001 | Ushida et al. | |
| 8,171,903 | B2 * | 5/2012 | Kim | 123/90.17 |
| 2002/0026915 | A1 | 3/2002 | Maeyama et al. | |
| 2003/0019449 | A1 | 1/2003 | Hiratsuka et al. | |
| 2008/0022952 | A1 * | 1/2008 | Suga et al. | 123/90.15 |
| 2008/0184948 | A1 * | 8/2008 | Boese et al. | 123/90.17 |
| 2011/0107991 | A1 * | 5/2011 | Kinouchi et al. | 123/90.17 |
| 2011/0197837 | A1 * | 8/2011 | Boese | 123/90.15 |
| 2011/0297113 | A1 * | 12/2011 | Arnold | 123/90.15 |
| 2012/0037104 | A1 * | 2/2012 | Pohl et al. | 123/90.15 |

(Continued)

FOREIGN PATENT DOCUMENTS

| | | |
|---|---|---|
| DE | 10331631 | 1/2005 |
| DE | 10044423 | 1/2009 |
| EP | 1400660 | 3/2004 |
| EP | 1400660 A1 * | 3/2004 |

*Primary Examiner* — Thomas Denion
*Assistant Examiner* — Steven D Shipe
(74) *Attorney, Agent, or Firm* — Volpe and Koenig, P.C.

(57) ABSTRACT

A stator-cover unit (1) for a camshaft adjuster (31), which is produced in one piece from a sintered material, including a stator (3) and a locking cover (5) which has a slot (17) for rotationally locking a rotor (33). According to the invention, the sintered material has at least in the region of the slot (17) a Vickers hardness of 400 HV to 850 HV. The invention further relates to a camshaft adjuster (31) having such a stator-cover unit (1) with the aforementioned properties, in which a rotor (33) having a number of radially outwardly extending rotor vanes (35) is positioned. The stator-cover unit (1) is simple to produce. A separate insertion part for the slot (17) is not required.

15 Claims, 3 Drawing Sheets

(56) References Cited

U.S. PATENT DOCUMENTS

2012/0180740 A1* 7/2012 Hayashi ..... 123/90.17
2012/0318222 A1* 12/2012 Weber ..... 123/90.15
2013/0047943 A1* 2/2013 Weber et al. ..... 123/90.15

* cited by examiner

SINTERED STATOR-COVER UNIT AND CAMSHAFT ADJUSTER

FIELD OF THE INVENTION

The invention relates to a stator-cover unit for a camshaft adjuster, comprising a stator and a locking cover that has a slot for the rotationally fixed locking of a rotor. The invention further relates to a camshaft adjuster with such a stator-cover unit. A stator-cover unit is typically used in a camshaft adjuster, in order to support the valve timing of an internal combustion engine in operation.

BACKGROUND

A stator-cover unit of the type named above has become a common component in the meantime and is used in modern internal combustion engines for motor vehicles. The stator-cover unit is part of a camshaft adjuster. It is used for actuating a camshaft or the cam attached to the camshaft. Gas exchange valves in an internal combustion engine can be actuated by the cams. The control times of the gas exchange valves can be set selectively by means of the arrangement and shape of the cams. Adapting the valve opening times by means of a camshaft adjuster allows the efficiency of the internal combustion engine to be increased. This produces, in particular, performance gains and/or fuel savings. For this reason, more and more improvements in this field are desired.

A camshaft adjuster typically includes a stator, a locking cover, a rotor positioned in the stator, and a sealing cover. The stator is locked in rotation with a crankshaft in the installed state, while the rotor is locked in rotation with a camshaft. The stator is typically constructed with at least one vane contact surface on which the vanes of a rotor are stopped in the installed state. Overall, the use of a camshaft adjuster allows a targeted rotation of the camshaft relative to the stator in a predetermined angular range. Thus, the phase position of the cam relative to the crankshaft can be changed within certain limits.

To be able to hold the stator and the rotor in an optimal position, especially when starting or idling an engine, a slot is typically formed within the locking cover. The slot is used for the rotationally fixed locking of the rotor, wherein a piston engages in the slot, so that the stator-cover unit is connected mechanically with a positive-fit connection to the rotor. Accordingly, high forces act on the slot in the locked state.

In U.S. Pat. No. 6,311,654 B1, a camshaft adjuster is disclosed with a stator-cover unit of the type named above. The stator-cover unit is produced in multiple parts, wherein the stator is connected by means of a bolt to a locking cover constructed as a sealing plate. A rotor is inserted into the stator-cover unit. The stator and the rotor can be fixed relative to each other by a piston engaging in a slot. The slot is formed as an annular depression in the housing base of the locking cover. In this depression, after the production of the locking cover, a conically tapering ring is pressed in as a separate insert part. The piston can engage in this ring, in order to lock the stator with the rotor.

A disadvantage in such a stator-cover unit, however, is the relatively high production and assembly expense. The required hardness and stability for locking the rotor and stator can be guaranteed by an insert part.

SUMMARY

Accordingly, a first objective of the invention is to specify an improved stator-cover unit that can be produced economically and with reduced complexity compared with the prior art, without adversely affecting its functional capability.

A second objective of the invention is to specify a camshaft adjuster with a corresponding stator-cover unit.

The first objective is met according to the invention by a stator-cover unit with the features of the invention.

Accordingly, the stator-cover unit for a camshaft adjuster is produced in one piece from a sintered material and comprises, as a structural unit, a stator and a locking cover. A slot for the rotationally fixed locking of a rotor is formed in the locking cover. Here it is provided that the sintered material has a Vickers hardness between 400 HV and 850 HV at least in the area of the slot.

Here, the invention takes into account, in particular, the increased loads that a stator-cover unit must withstand in the installed state as a part of a camshaft adjuster. In particular, the stator-cover unit must be constructed with a suitable hardness in the area of the slot, because this area is used as a loaded functional surface on which the piston engages with the stator for the mechanical locking of the rotor.

In consideration of this, separate insert parts that are distinguished by the required hardness are typically inserted into a locking cover. For mounting the insert parts, depressions are formed in the locking cover, wherein these depressions are typically formed by metal cutting processes. For the function of the locking mechanism, a reference to the geometries of the insert part, rotor, and stator relative to each other must be established. For this purpose, in particular, the vane contact surface belonging to the slot must be subjected to a metal-cutting post-processing process. These additional processes cause increased assembly costs in the production. In addition, an insert part is subject to additional tolerances.

To overcome these disadvantages, the invention recognizes that the use of a stator-cover unit produced in one piece from a sintered material in connection with a correspondingly hard functional surface in the area of the slot gives the ability to produce the stator-cover unit without additional expense, both in terms of production and also costs. The use of a sintered material provides the ability of using an easy-to-handle and practice-tested method for production.

The base material of the stator-cover unit is a sintered material that has a hardness between 400 HV and 850 HV at least in the area of the slot. For producing a component, powder masses are pressed into a so-called green compact that is then compressed and hardened by a heat treatment at the melting temperature. Sintered materials can be selected according to the requirements for the components for which they are used. For this purpose, additional alloy components, for example, could be added.

The hardness of a sintered component is given basically by the sintered material. Here, the entire stator-cover unit could have the same hardness essentially at all positions after production. By means of a heat treatment, however, for suitable materials post-hardening could be performed. In particular, post-hardening could be performed in local areas. Especially in the area of the slot, that is, at the point at which high loads act due to the mechanical locking of the rotor and stator, a Vickers hardness between 400 HV and 850 HV can be provided. Hardness can be defined generally as the mechanical resistance that a material exhibits to the mechanical penetration of a harder test body. The hardness measurement according to Vickers is generally used for testing hard and uniformly constructed materials, like the hardness testing of thin-walled or surface-hardened workpieces and edge zones. Here, a diamond pyramid with equal sides and an opening angle of 136° is pressed into the workpiece with a fixed testing force. The impression surface is calculated from the length of the diagonals of the permanent impression determined by means of a microscope. The ratio of testing force to impression surface gives the Vickers hardness (HV) by multiplying with a factor (0,1891).

The selected hardness area between 400 HV and 850 HV provides the ability to construct the stator-cover unit at least in the area of the slot so that it is always adequate for such loads. In particular, no undesired deformation occurs there. On the other hand, the hardness is small enough that the material is not or will not be brittle and possibly cracks under load.

Due to the one-piece production, the production of the stator-cover unit can be shortened and the costs can be reduced, because, in particular, additional fastening means or assembly steps are eliminated for connecting the stator to the locking cover. In addition, the component tolerances are kept low. Because each production process has only a finite production accuracy, each produced component has small deviations from the desired geometry. In a multi-step production process, geometric deviations of the individual components add up and the total error becomes larger. Accordingly, in a single-piece production, only the tolerances or errors of a single component, that is, the stator-cover unit, must be taken into consideration. In contrast, for joining a separate stator and a separate locking cover, a larger error would be produced for the stator-cover unit.

The stator could be dimensioned differently. The dimensioning depends, in particular, on the size of the camshaft at which actuation of the stator is required. The stator is connected to the locking cover, in particular, in the form of a combined stator-cover unit. It could be constructed with a number of connecting pieces that are formed on the inner wall of the stator and extend inward in the radial direction. The vanes of a rotor can be positioned between the connecting pieces, so that pressure chambers for pressurizing with hydraulic fluid are produced on the outsides of the vanes.

The locking cover bounds the pressure chambers or the interior of the stator-cover unit on one side. It is used for sealing the pressure space and prevents uncontrolled run-out of hydraulic fluid. The single-piece production of the locking cover with the stator guarantees high leak tightness when the interior is pressurized with oil.

The slot is used, as already mentioned above, for locking the stator and rotor, so that these are held in an optimum position, especially for the startup or idle running of an internal combustion engine. The slot is constructed within a chamber or within a pressure chamber in the form of a recess in the locking cover. The position of the slot is here defined, in particular, by the production process. It must lie within the locking play so that the piston can engage in the recess. Post processing of the vane contact surfaces of the stator-cover unit and the locking slot is not required. Thus, no additional errors are generated. In this way, the tolerance chain remains unaffected with respect to the distance between the vane contact surfaces and the slot.

If the material-dependent hardness is not sufficient after the production of the stator-cover unit by means of sintering, the molded part formed by sintering can also be hardened at a later time. This is possible especially in the use of sintered steels. Here it is basically possible to harden the entire stator-cover unit or also only a part of this unit. Advantageously, the sintered material is a sintered steel that is hardened at least in the area of the slot. A sintered steel is desirable especially due to its simple processing and handling. A material that can be hardened provides the ability to produce the stator-cover unit so that the slot included in the locking cover has the required stability and also no additional insert parts are needed.

As the steel, basically metal alloys are designated whose main component is iron and whose carbon content lies between 0.01% and 2.06%. By alloying with carbon and other alloy elements in combination with heat treatments and thermo-mechanical treatments, steels can be modified and made usable for a wide range of applications. The lower the carbon content is, the greater the steel can deform, while the steel becomes stronger, but also more brittle, with increasing carbon content. The steel can fracture, for example, if the carbon content in the steel is too high. Accordingly it is necessary to use a material that is neither too soft nor too brittle due to its carbon content. A steel that can be hardened should contain at least 0.2% carbon. Preferably the sintered steel has a carbon content between 0.2 and 1.0 wt. % accordingly. In this range, the steel can be hardened and nevertheless there is no risk of fracture or becoming too brittle.

Due to the hardening of the sintered steel, an increase in its mechanical resistance is produced through targeted modification and conversion of its structure. Hardening can be performed, for example, by heat treatment with subsequent rapid cooling. Here, different hardening processes are distinguished, such as, for example, transformation hardening, precipitation hardening, and also cold work hardening, which can each be applied as a function of the present component and the desired results.

In one especially advantageous construction of the invention, the carbon content lies between 0.4 and 0.8 wt. %. For such a value, the ratio between required hardness and fracture strength is especially favorable. In particular, it is here desired that the strength of the stator-cover unit and especially the hardness of the locking cover at the functional surface, that is, in the area of the slot, is specified, in order to be able to guarantee the stability required for the locking.

The sintered steel preferably has a density in the range between 6.6 g/cm$^3$ and 7.3 g/cm$^3$. The density is given, in particular, from the carbon content of the sintered steel. The larger the carbon content is, the higher the density of the material. The density can also be influenced by alloy components that are added to the material, for example, before the sintering.

Preferably, the sintered steel also contains nickel with a content less than 5 wt. % and/or molybdenum with a content less than 1 wt. %, as well as a remainder of unavoidable contaminants. A sintered steel of the designation Sint D11 corresponding to DIN 30910-4 from the supplier ML Sinter Solutions Dusseldorf is provided, in particular. In principle, however, any sintered material or sintered steel is conceivable that corresponds to the stated requirements.

In one advantageous construction of the invention, the stator has a number of connecting pieces that extend inward in the radial direction and of which at least one connecting piece is formed with a vane contact surface. Pressure chambers in which the vanes of a rotor are positioned in the installed state are formed within the stator by the connecting pieces. At least one connecting piece here has a vane contact surface on which the vanes contact, so that the rotor or its vane is stopped and the position of the camshaft is fixed. Overall, one or more connecting pieces can be formed with vane contact surfaces. The other connecting pieces of the stator, whose walls are not constructed as vane contact surfaces, are then used mainly for bounding the chambers or the pressure chambers.

Advantageously, the locking cover has, in the area of the connecting pieces, countersunk depressions that each extend away from a connecting piece as a ring section in the peripheral direction. The depressions are countersunk relative to the other level of the locking cover and formed, in particular, directly at the contact point between the connecting piece and the locking cover. The depressions allow excess material, for example, radii, produced at these points during production to remain, because it is located only in the countersunk depressions of the locking cover and has absolutely no interring effect on the function of the camshaft adjuster. Post processing of the depressions is no longer necessary. The depressions can be constructed in a cost-neutral manner on the sintered component, because these are already taken into account in the shape-forming mold.

Preferably, each ring section extends away from the connecting piece in the peripheral direction at a maximum up to the width of a rotor vane. In this way, in the installed state of a rotor, in particular, a short circuit between the pressure chambers on the right and left of a vane can be prevented. With dimensions selected in this way, oil can flow from one pressure chamber via the vane into a second pressure chamber and thus the functioning of the camshaft adjuster is reliably guaranteed at all times.

To guarantee the functionality of the camshaft adjuster, the depressions have essentially the same radial length as the connecting pieces in the radial direction. Through this configuration, a rotor vane that extends in the radial direction up to the inner wall of the stator or the stator-cover unit can perform its movement at any position, independent of any possible excess material.

Through the constructions of the depressions only in the area of the connecting pieces or, in particular, in the area of the vane contact surfaces, sufficient stability of the stator-cover unit remains guaranteed. In particular, in the part of the locking cover that connects the connecting pieces inward in the radial direction and encloses a camshaft in the installed state of the stator-cover unit, the material thickness maintains the requirements accordingly.

In an especially advantageous construction of the invention, the connecting pieces, in particular, the vane contact surfaces, transition via radii into the depressions. In other words, the radii are intentionally maintained. These radii are located, as already mentioned, within the depressions and do not project past the level of the locking cover. Accordingly, they have absolutely no disadvantageous effects on the functioning of the stator-cover unit and friction-less operation of a camshaft adjuster can be guaranteed. By means of the radii and their reinforcing effect, the stability and thus the durability of a stator-cover unit can be effectively increased.

Preferably the piston extends into the adjacent recess until it is inside. This construction is used, in particular, for the hydraulic unlocking of a piston. Because depressions are already present in the locking cover, these can be used for pressurizing the pressure space formed by the slot with oil. When the internal combustion engine is started, pressure builds up in the pressure space. The piston that fixes the stator-cover unit in the locked state on the vane of the rotor is pressed upward. The connection between the stator and rotor is detached. To fill the slot with oil, a part of the depression is thus already used. Thus, an additional processing step, like the later formation of a separate groove, is eliminated and additional costs can be saved.

The second objective is also met according to the invention by a camshaft adjuster with the features of the invention.

Accordingly, the camshaft adjuster comprises a stator-cover unit corresponding to the constructions mentioned above, in which a rotor is positioned with a number of rotor vanes extending outward in the radial direction.

The rotor is formed in the stator-cover unit for a camshaft adjuster. The rotor is locked in rotation with the camshaft and is turned by means of the movement of the stator. The rotor vanes extending outward in the radial direction are located in the installed state between the chambers that are limited by the connecting pieces of the stator extending inward in the radial direction. The chambers are divided by the rotor vanes into two pressure chambers. The rotor has, in particular, oil channels in its base body, wherein oil can be pumped through these channels into the pressure chambers of the stator-cover unit for the hydraulic operation of the camshaft adjuster. By rotating the rotor relative to the stator, the phase position of the camshaft or the cam and thus the opening times of the valves in a motor can be controlled. The possible rotational angle of the rotor is dependent, in particular, on the size of the pressure chamber just like on the width of the vane or on the ratio of the two relative to each other.

Preferably, the width of a rotor vane corresponds at least to the size of a depression in the peripheral direction. Here, oil cannot be led in an undesired manner via the depressions from one pressure chamber into a second pressure chamber and thus lead to a short circuit between the pressure chambers.

Other advantageous constructions can be found in the dependent claims, wherein the advantages named for the stator-cover unit can be transferred analogously to the camshaft adjuster.

BRIEF DESCRIPTION OF THE DRAWINGS

Embodiments of the invention are explained below with reference to the drawings. Shown are.

Identical components in the individual embodiments are given the same reference symbols below.

DETAILED DESCRIPTION OF THE PREFERRED EMBODIMENTS

Figure 1:
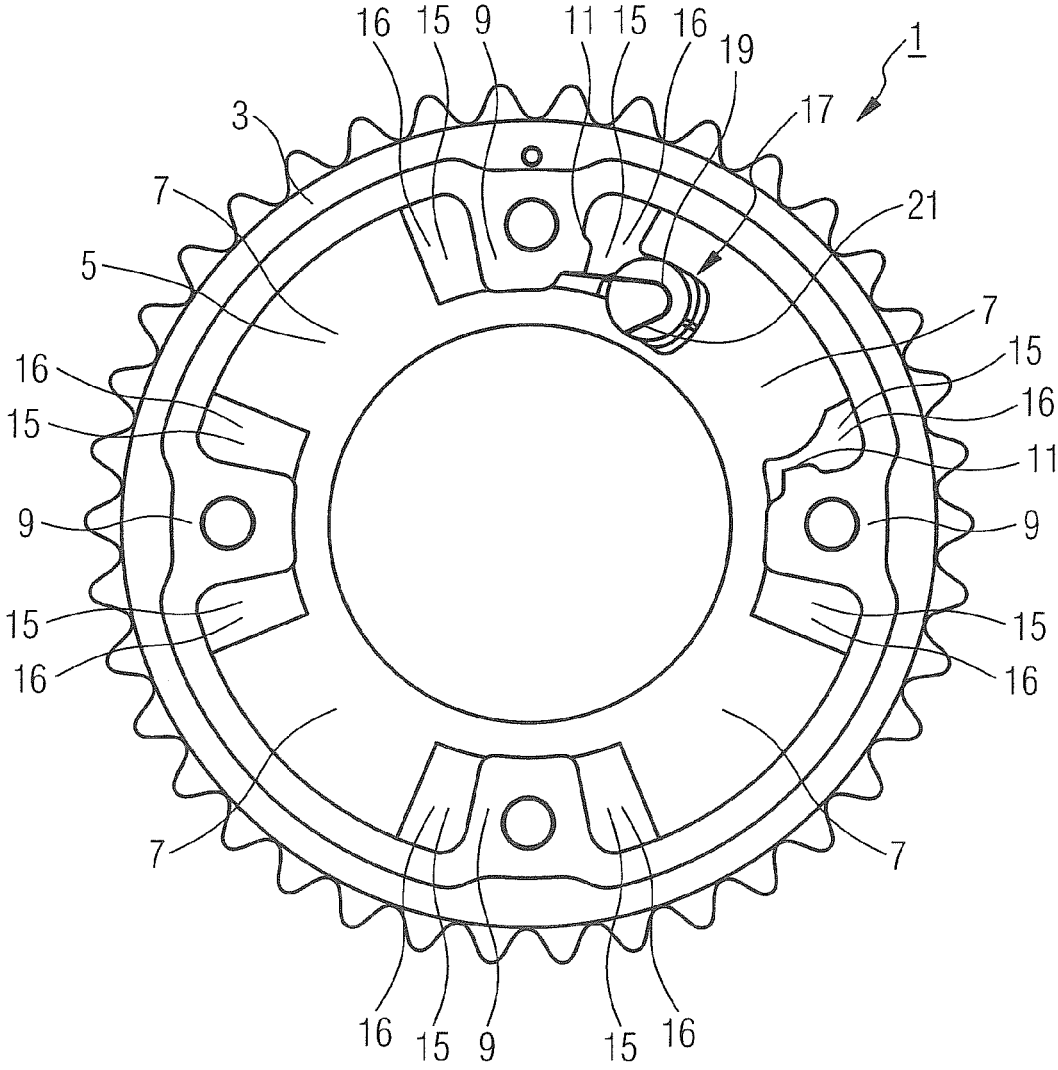
FIG. 1 is a top view of a stator-cover unit.

FIG. 1 shows a stator-cover unit 1 with a stator 3 and a locking cover 5 in a top view. The stator-cover unit 1 that is also designated as a so-called stator pot is produced in one piece by a sintering method. In this way, in addition to simple manufacturing, the leak tightness of the stator-cover unit 1 is guaranteed and the spring-back tolerances are reduced. Post processing is likewise no longer necessary or only to a minimal extent. The stator-cover unit 1 can be locked in rotation with a drive wheel driven by a crankshaft, which is not shown in FIG. 1.

The stator-cover unit 1 is produced as a component by sintering from a sintered steel Sint D11. The sintered steel has a carbon content of 0.6 wt. % and a density of 6.8 g/cm$^3$. The stator-cover unit 1 is hardened locally in the area of the slot 17 by a heat treatment and has a Vickers hardness of 500 HV5 in this area. The stator-cover unit 1 or the material in the area of the slot 17 has no risk of cracking or deforming under loading.

The stator 3 forms four chambers 7 that are separated from each other by connecting pieces 9 extending inward in the radial direction. Two of the connecting pieces 9 of the stator 3 or the respective connecting piece walls are constructed as vane contact surfaces 11. The vanes of a rotor not shown in FIG. 1 can contact the vane contact surfaces 11 and thus define the position of a camshaft.

In the locking cover 5 there are already depressions 15 formed during the production of the stator-cover unit 1 in the area of the connecting pieces 9. The depressions 15 are each constructed in the form of a ring section 16. They extend away from the connecting pieces 9 in the peripheral direction.

The depressions 15 can have radii that are formed during the production and are not to be seen in FIG. 1, without obstructing or limiting the functional capability of the stator-cover unit 1. The radii do not project past the level of the locking cover 5, so that they do not interfere with the movement of a rotor vane. For this reason, radii formed during production can remain in the depressions 15, increasing the stability and durability of the stator-cover unit 1 in addition to reducing production costs and complexity.

The stator-cover unit 1 has a slot 17 in the form of a round recess 19. The recess 19 is formed adjacent to a depression 15. A piston not shown in FIG. 1 can engage in this recess 19, wherein this piston is used for the rotationally fixed locking of the stator 3 with a rotor. The rotor cannot be seen in the present view, but can be found in FIG. 3.

A groove 21 leads from the recess 19 up to the depression 15. The groove 21 is constructed as part of the depression 15 and is likewise already formed in the scope of the production of the stator-cover unit 1. Through the use of this groove 21, oil can be forced out from the depression 15 underneath the piston. The groove 21 is thus used for supplying oil to the slot 17, in order to allow the piston to be lifted and thus hydraulic unlocking of the rotor.

Figure 2:
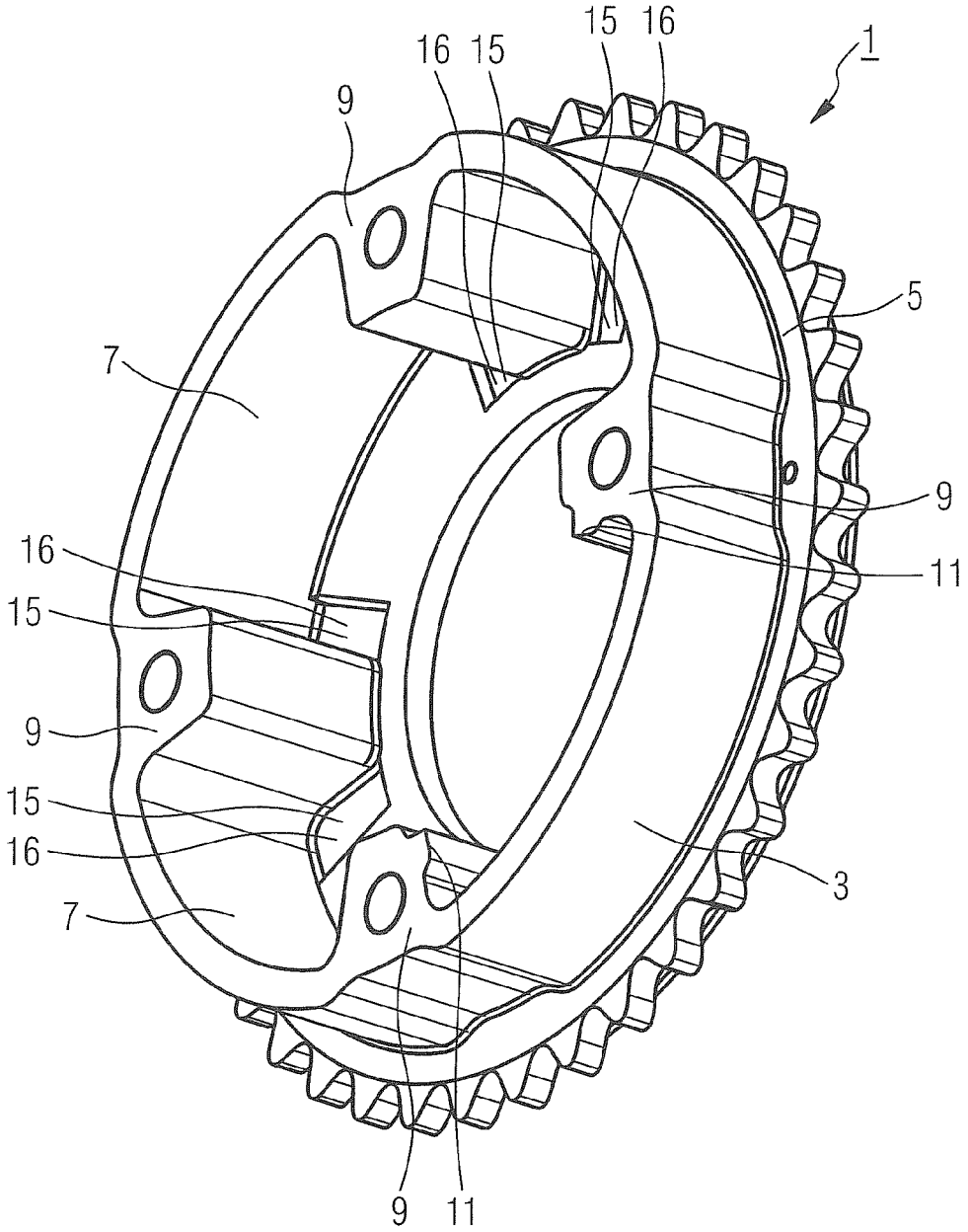
FIG. 2 is a view of the stator-cover unit according to FIG. 1 in a three-dimensional representation.

In FIG. 2, the stator-cover unit 1 according to FIG. 1 can be seen in a three-dimensional representation with the stator 3 and the locking cover 5. The depressions 15 located in the locking cover 5 can now be seen clearly. The formation of the depressions 15 as ring sections that extend in the peripheral direction away from the connecting pieces 9 can be seen clearly. The depressions 15 are formed at the contact points between the connecting pieces 9 and the locking cover 5 and have the same length as the connecting pieces 9 in the radial direction. This guarantees that a rotor vane extending in the radial direction up to the inner wall of the stator-cover unit 1 is not obstructed in its movement at any point by a material projection. Radii possibly remaining during the production process remain interference-free in the depressions 15 and stabilize the stator-cover unit 1.

Figure 3:
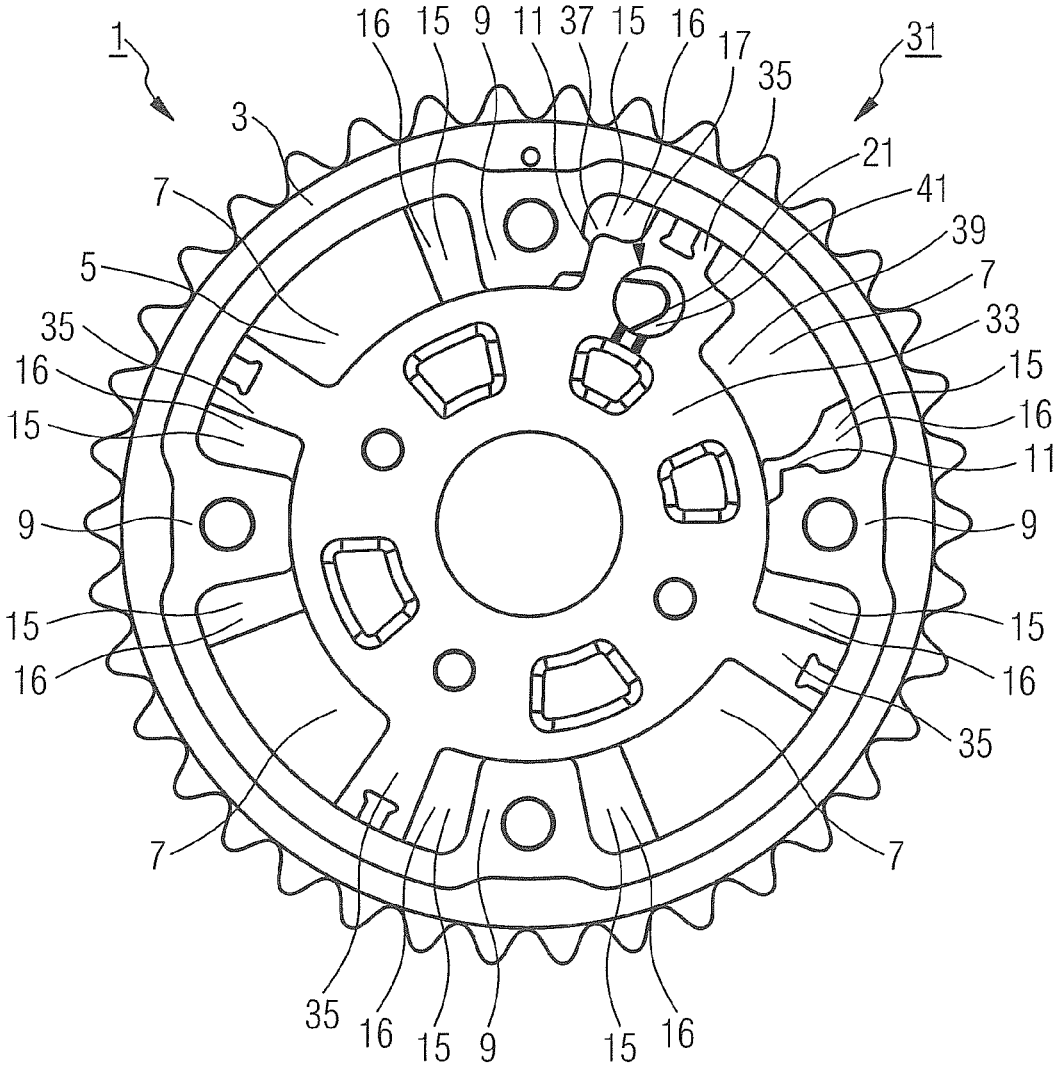
FIG. 3 is a top view of a camshaft adjuster with a stator-cover unit according to FIGS. 1 and 2 and an installed rotor.

FIG. 3 shows a camshaft adjuster 31 with a stator-cover unit 1 according to FIGS. 1 and 2. In the stator-cover unit 1, a rotor 33 with four vanes 35 is inserted. The vanes 35 of the rotor 33 are each located in one chamber 7. This is separated by the vanes 35 in every two individual pressure chambers 37, 39 or hydraulic areas that are then located to the right or left from the vane 35. For reasons of clarity, the pressure chambers 7 are shown only in the chamber 7 in which the vane contact surfaces 11 are also constructed on the connecting pieces 9. The rotor 33 has oil channels for loading the pressure chambers 37, 39 with oil, wherein these channels cannot be seen, because they are located in the interior of the body of the rotor 33.

The connecting pieces 9 or the connecting walls of the stator 3 allow a limited rotational angle of rotor 33. The vanes 35 of the rotor 33 are stopped in a certain position by contact on the connecting wall formed as vane contact surface 11. In FIG. 3, two connecting pieces 9 are each constructed with one vane contact surface 11. Both vane contact surfaces are located within a chamber 7, so that the rotor vane 35 can contact both sides of the chamber 7.

The vanes 35 are constructed wider in the peripheral direction than the depression 15. This dimensioning prevents an exchange of oil between the hydraulic areas 37, 39, that is, the areas of a chamber 7 separated from each other. Such a short circuit could not guarantee correct functioning of the camshaft adjuster 31.

In a vane 35 of the rotor 33, a hole 41 is formed. A piston not shown in FIG. 3 engages in a locking position through the hole 41 into the slot 17 in the locking cover 5. Thus, the rotor 33 can be held in a provided position.

For unlocking, pressure is built up in the slot 17 via the groove 21 when the internal combustion engine is started. This lifts the piston that holds the stator-cover unit 1 in the locked state on the vane 35 of the rotor 33 and the rotor 33 can move to a defined adjustment angle.

LIST OF REFERENCE SYMBOLS

1 Stator-cover unit
3 Stator
5 Locking cover
7 Chamber
9 Connecting piece
11 Vane contact surface
15 Depression
16 Ring section
17 Slot
19 Recess
21 Groove
31 Camshaft adjuster
33 Rotor
35 Vane
37 Pressure chamber
39 Pressure chamber
41 Hole

The invention claimed is:

1. A stator-cover unit for a camshaft adjuster, comprising a stator and a locking cover produced in one piece from a sintered material, the locking cover has a slot for rotationally fixed locking of a rotor, and the sintered material has a Vickers hardness between 400 HV and 850 HV at least in an area of the slot.

2. The stator-cover unit according to claim 1, wherein the sintered material is a sintered steel hardened at least in the area of the slot.

3. The stator-cover unit according to claim 2, wherein the sintered steel has a carbon content between 0.2 wt. % and 1.0 wt. %.

4. The stator-cover unit according to claim 3, wherein the carbon content is between 0.4 wt. % and 0.8 wt. %.

5. The stator-cover unit according to claim 2, wherein the sintered steel comprises a copper content between 1 wt. % and 5 wt. %.

6. The stator-cover unit according to claim 2, wherein the sintered steel has a density in a range between 6.6 g/cm$^3$ and 7.3 g/cm$^3$.

7. The stator-cover unit according to claim 2, wherein the sintered steel also contains at least one of nickel with a content of less than 5 wt. % or molybdenum with a content less than 1 wt. %.

8. The stator-cover unit according to claim 1, wherein the stator has a number of connecting pieces extending inward in a radial direction and at least one of the connecting pieces is constructed with a vane contact surface.

9. The stator-cover unit according to claim 8, wherein the locking cover has depressions that are recessed in an area of the connecting pieces and extend away from a respective one of the connecting pieces in a peripheral direction as a ring section.

10. The stator-cover unit according to claim 9, wherein each of the ring sections extends away from the connecting piece in the peripheral direction at a maximum up to a width of a rotor vane.

11. The stator-cover unit according to claim 9, wherein the depressions have essentially a same radial length as the connecting pieces in the radial direction.

12. The stator-cover unit according to claim 9, wherein the connecting pieces each transition into a corresponding one of the depressions.

13. The stator-cover unit according to claim 9, wherein one of the depressions adjacent to the slot extends into the slot.

14. A camshaft adjuster with the stator-cover unit according to claim 1, further comprising a rotor positioned with a number of rotor vanes extending outward in the radial direction.

15. The camshaft adjuster according to claim 14, wherein a width of a rotor vane corresponds at least to a width of a depression in the peripheral direction.

* * * * *